US007428925B2

(12) United States Patent
Brown et al.

(10) Patent No.: US 7,428,925 B2
(45) Date of Patent: Sep. 30, 2008

(54) WELLBORE FORMATION EVALUATION SYSTEM AND METHOD

(75) Inventors: Jonathan Brown, Sugar Land, TX (US); Danny A. Hlavinka, Houston, TX (US); David Ayers, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 28 days.

(21) Appl. No.: 11/284,077

(22) Filed: Nov. 21, 2005

(65) Prior Publication Data

US 2007/0114021 A1 May 24, 2007

(51) Int. Cl.
*E21B 47/00* (2006.01)

(52) U.S. Cl. ..... 166/264; 166/100; 73/152.24

(58) Field of Classification Search ..... 166/264, 166/101, 59, 100; 73/152.17, 152.24, 152.23
See application file for complete search history.

(56) References Cited

U.S. PATENT DOCUMENTS 2,671,323 A 3/1954 Richert
2,711,084 A 6/1955 Bergan
3,254,531 A 6/1966 Briggs, Jr. et al.
3,577,781 A 5/1971 Lebourg et al.
3,577,782 A 5/1971 Aitken
3,577,783 A 5/1971 Whitten et al.
3,859,851 A 1/1975 Urbanosky
4,676,096 A 6/1987 Bardsley et al.
4,860,581 A 8/1989 Zimmerman et al.
4,936,139 A 6/1990 Zimmerman et al.
5,184,508 A 2/1993 Desbrandes
5,265,677 A 11/1993 Schultz
5,303,775 A 4/1994 Michaels et al.
5,353,637 A * 10/1994 Plumb et al. ..... 73/152.17
5,377,755 A 1/1995 Michaels et al.
5,522,452 A 6/1996 Mizuno et al.
5,644,076 A * 7/1997 Proett et al. ..... 73/152.41
5,663,559 A 9/1997 Auzerais et al.
5,701,751 A 12/1997 Flores
5,715,895 A 2/1998 Champness et al.

(Continued)

FOREIGN PATENT DOCUMENTS

WO WO2005047647 5/2005

(Continued)

*Primary Examiner*—Jennifer H Gay
*Assistant Examiner*—Robert E Fuller
(74) *Attorney, Agent, or Firm*—Matthias Abrell Jaime Castano

(57) ABSTRACT

A formation evaluation tool positionable in a wellbore penetrating a subterranean formation is provided. The formation evaluation tool includes a cooling system adapted to pass a cooling fluid near electronics in the formation evaluation tool whereby heat is dissipated therefrom, the electronics has at least one gauge, a fluid communication device having an inlet adapted to receive the formation fluid and a flowline operatively connected to the fluid communication device and the gauge for placing the formation fluid in fluid communication therewith whereby properties of the formation fluid are determined. The formation evaluation tool may also be provided with a plurality of sample chambers operatively connected to the flowline for collecting at least a portion of the formation fluid and a pressure compensator in fluid communication with the wellbore and operatively connected to the plurality of sample chambers for applying pressure to the sample chambers whereby pressure is balanced therebetween.

14 Claims, 5 Drawing Sheets

U.S. PATENT DOCUMENTS

| | | | | |
|---|---|---|---|---|
| 5,839,508 | A | 11/1998 | Tubel et al. | |
| 5,934,374 | A * | 8/1999 | Hrametz et al. | 166/264 |
| 6,336,408 | B1 | 1/2002 | Parrott et al. | |
| 6,341,498 | B1 | 1/2002 | DiFoggio | |
| 6,467,544 | B1 | 10/2002 | Brown et al. | |
| 6,659,177 | B2 | 12/2003 | Bolze et al. | |
| 6,668,924 | B2 | 12/2003 | Bolze et al. | |
| 6,688,390 | B2 | 2/2004 | Bolze et al. | |
| 6,745,835 | B2 | 6/2004 | Fields | |
| 6,769,487 | B2 | 8/2004 | Hache | |
| 6,843,118 | B2 * | 1/2005 | Weintraub et al. | 73/152.05 |
| 6,877,332 | B2 | 4/2005 | DiFoggio | |
| 2002/0104328 | A1 * | 8/2002 | DiFoggio | 62/259.2 |
| 2003/0033866 | A1 | 2/2003 | Diakonov et al. | |
| 2003/0042021 | A1 * | 3/2003 | Bolze et al. | 166/264 |
| 2004/0007058 | A1 | 1/2004 | Rylander et al. | |
| 2004/0106524 | A1 | 6/2004 | Jones et al. | |
| 2004/0216874 | A1 | 11/2004 | Grant et al. | |
| 2004/0218176 | A1 | 11/2004 | Shammal et al. | |
| 2004/0264543 | A1 | 12/2004 | Storm et al. | |
| 2005/0097911 | A1 | 5/2005 | Revellat et al. | |
| 2005/0150287 | A1 | 7/2005 | Carnegie et al. | |
| 2005/0161218 | A1 | 7/2005 | Van Zuilekom et al. | |
| 2005/0257533 | A1 | 11/2005 | Gunawardana et al. | |

FOREIGN PATENT DOCUMENTS

| | | |
|---|---|---|
| WO | WO2005052315 | 6/2005 |

* cited by examiner

WELLBORE FORMATION EVALUATION SYSTEM AND METHOD

BACKGROUND OF THE INVENTION

1. Field of the Invention

The present invention relates to apparatuses and methods for evaluating subsurface formations in wellbore operations. More particularly, the present invention relates to wellbore systems for performing formation evaluation, such as testing and/or sampling, using a downhole tool positionable in a wellbore penetrating a subterranean formation.

2. Background of the Related Art

Wellbores are drilled to locate and produce hydrocarbons. A downhole drilling tool with a bit at an end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to perform various evaluations of the formations penetrated by the wellbore. In some cases, the drilling tool may be provided with devices to test and/or sample the surrounding formation. In some cases, the drilling tool may be removed and a wireline tool may be deployed into the wellbore to test and/or sample the formation. In other cases, the drilling tool may be used to perform the testing or sampling. These samples or tests may be used, for example, to locate valuable hydrocarbons.

Formation evaluation often requires that fluid from the formation be drawn into the downhole tool for testing and/or sampling. Various fluid communication devices, such as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of fluid communication devices, such as probes and/or packers, used in downhole tools are described in U.S. Pat. No. 6,301,959; 4,860,581; 4,936,139; 6,585,045; 6,609,568 and 6,719,049 and U.S. Patent Application No. 2004/0000433.

Once the fluid enters the downhole tool, it may be tested, collected in a sample chamber and/or discharged into the wellbore. Techniques currently exist for drawing fluid into the downhole tool and/or performing various downhole operations, such as downhole measurements, pretests and/or sample collection of fluids that enter the downhole tool. Examples of such techniques may be found in U.S. Pat. Nos. 4,860,581; 4,936,139; 5,303,775; 5,934,374; 6,745,835 3,254,531; 3,859,851; 5,184,508; 6,467,544; 6,659,177; 6,688,390; 6,769,487; 2003/042021; 2004/0216874; and 2005/0150287.

In some cases, the wellbore environment may be exposed to extremely high temperatures and/or pressures which may cause electronics and other tool components to fail. Techniques for cooling instrumentation, such as electronic circuits, in a downhole tool are described, for example, in U.S. patent/application Nos. 5,701,751; 6,769,487 and US 2005/0097911.

Despite the development and advancement of formation evaluation techniques in wellbore operations, there remains a need to provide a formation evaluation system capable of operating in even the harshest wellbore environments having extreme temperatures and/or pressures. It is desirable that such a system be capable of efficiently cooling electronics in the downhole tool. It is further desirable that such a system eliminate, reduce and/or protect components that are subject to failure in harsh wellbore conditions. Such a system preferably provides one or more of the following among others: a fluid flow system that does not require a pump to draw fluid into the tool, consolidated electronics for efficient cooling, gauges (such as formation fluid sensors) located with or near the consolidated electronics for cooling, pressure balanced sample and/or dump chambers and increased cooling efficiency.

SUMMARY OF THE INVENTION

In at least one aspect, the present invention relates to a formation evaluation tool positionable in a wellbore penetrating a subterranean formation. The formation evaluation tool includes a cooling system adapted to pass a cooling fluid near electronics in the formation evaluation tool whereby heat is dissipated therefrom, the electronics comprising at least one gauge, a fluid communication device having an inlet adapted to receive the formation fluid and a flowline operatively connected to the fluid communication device and the at least one gauge for placing the formation fluid in fluid communication therewith whereby properties of the formation fluid are determined.

In another aspect, the invention relates to a formation evaluation tool positionable in a wellbore penetrating a subterranean formation a fluid communication device having an inlet adapted to receive a formation fluid, a flowline operatively connected to the fluid communication device, a plurality of sample chambers operatively connected to the flowline for collecting at least a portion of the formation fluid and a pressure compensator in fluid communication with the wellbore and operatively connected to the plurality of sample chambers for applying pressure to the sample chambers whereby pressure is balanced therebetween.

In yet another aspect, the invention relates to a method of performing formation evaluation via a downhole tool positioned in a wellbore penetrating a subterranean formation. The method involves removing heat from electronics in the downhole tool by passing a cooling fluid near the electronics, the electronics comprising at least one gauge, establishing fluid communication between a fluid communication device and the formation, the fluid communication device having an inlet adapted to receive a formation fluid from the formation, establishing fluid communication between the inlet and the at least one gauge via a flowline and measuring at least one parameter of the formation fluid via the gauge.

Finally, in another aspect, the invention relates to a method of performing formation evaluation via a downhole tool positioned in a wellbore penetrating a subterranean formation establishing fluid communication between a fluid communication device and the formation, the fluid communication device having an inlet adapted to receive a formation fluid from the formation, drawing formation fluid through the inlet and into a plurality of sample chambers via a flowline, each of the plurality of sample chambers having a movable piston slidably positioned therein, the movable piston defining a variable volume sample cavity and a variable volume buffer cavity, the variable volume sample cavity adapted to receive the formation fluid, establishing fluid communication between a wellbore cavity of a pressure compensator and the wellbore and balancing the pressure between the variable volume buffer cavities and the wellbore cavity.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
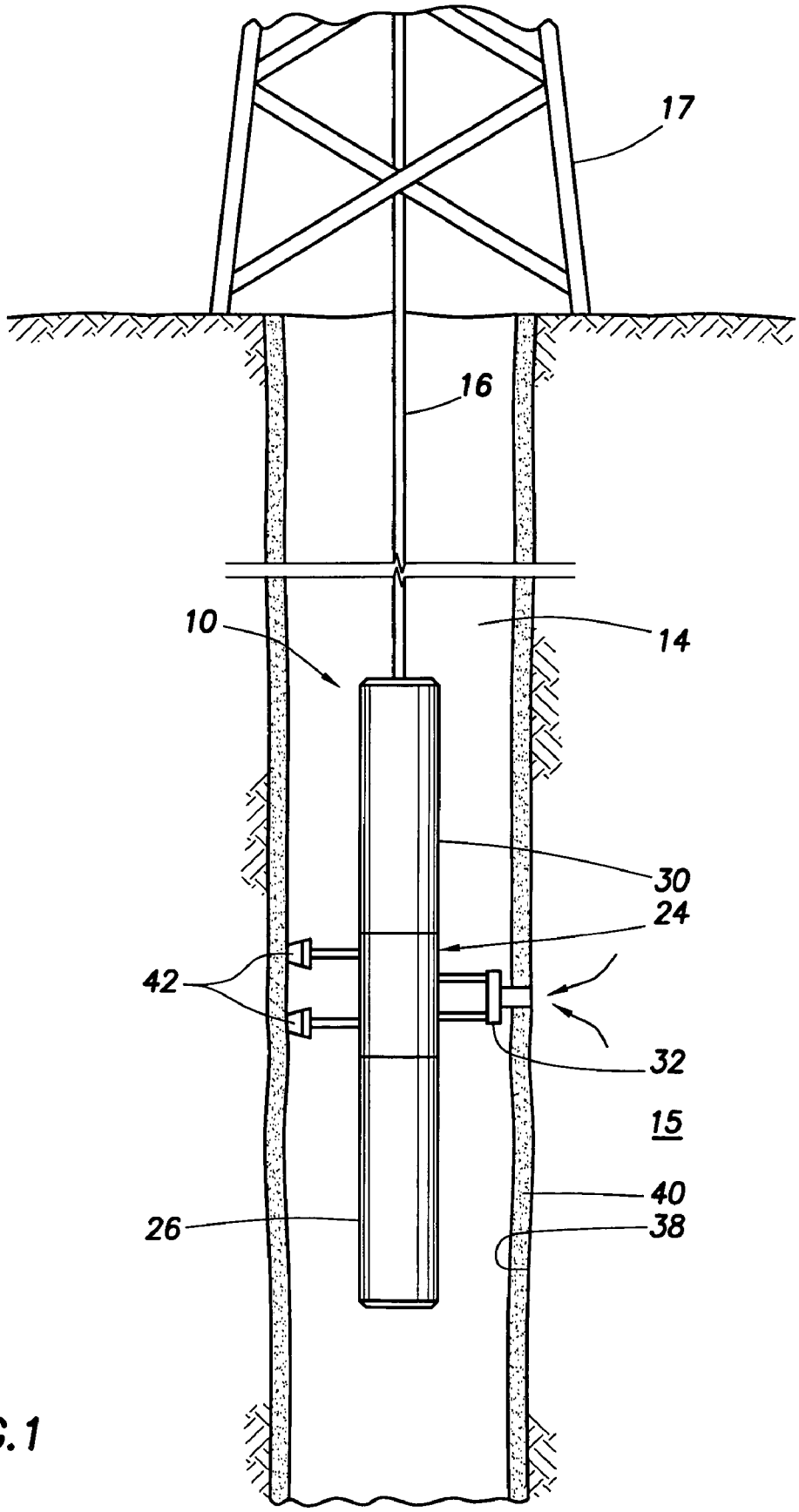
FIG. 1 is a side-elevational, partial cross-sectional view of a downhole tool positioned in a borehole penetrating a subsurface formation.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Referring to FIG. 1, an example environment within which the present invention may be used is shown. The downhole tool 10 of FIG. 1 is a wireline tool deployed into a borehole 14 and suspended therein adjacent a subsurface formation 15 with a conventional wire line 16 (or conductor or conventional tubing or coiled tubing) below a rig 17. Mudcake 40 lines the wellbore wall 38. While an open hole wellbore with mudcake is depicted, it will be appreciated that this downhole tool may be used in open or cased wellbores. The downhole tool 10 may be a formation evaluation tool such as the example wireline tool depicted in U.S. Pat. Nos. 4,936,139 and 4,860,581.

While FIG. 1 depicts a modular wireline sampling tool for collecting samples, the downhole tool 10 can be any downhole tool capable of performing formation evaluation, such as a drilling, casing drilling, completions, coiled tubing, robotic tractor or other downhole system. Additionally, the downhole tool 10 may have alternate configurations, such as modular, unitary, autonomous and other variations of downhole tools.

The illustrated downhole tool 10 is provided with various modules and/or components, including, but not limited to a probe module 24, a sampling module 26 and an electronics module 30. The probe module includes a probe assembly 32 and backup pistons (or loading pistons, bow spring, etc.) 42.

Figure 2:
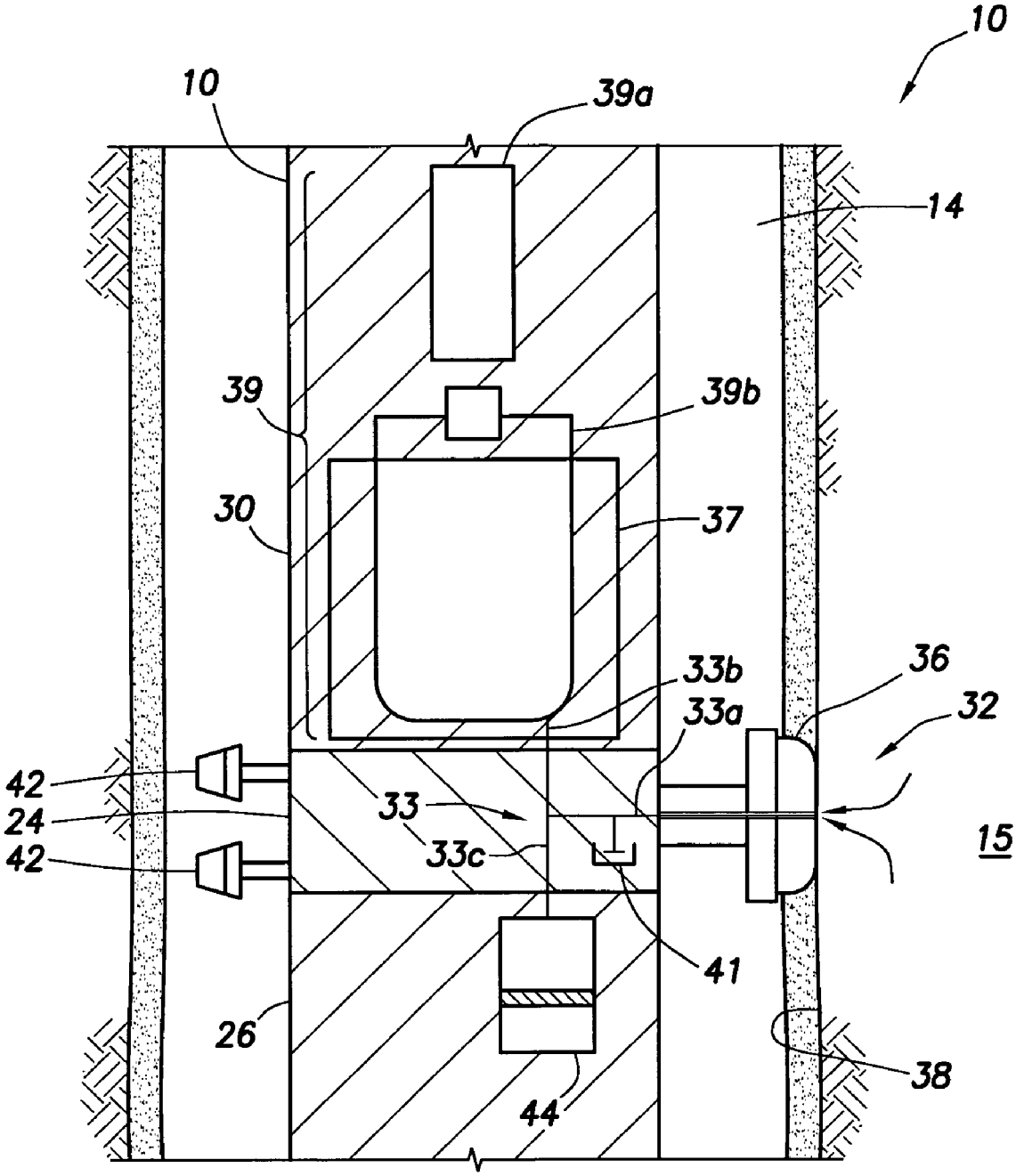
FIG. 2 is a schematic view of a portion of the downhole tool of FIG. 1 depicting a formation evaluation system and a cooling system.

Referring to FIG. 2, a portion of the downhole tool of FIG. 1 is shown in more detail. The components of the modules of FIG. 1 are also shown in more detail. As shown, these components are in specific modules. However, these components may be positioned in one or more modules or drill collars, or in a unitary tool.

The electronics module 30 includes electronics 37 and a cooling system 39. Cooling system 39 includes a cooling driver 39*a* and a cooling flow unit 39*b*. The sampling module 26 includes a sample chamber 44. The probe module 24 includes a probe assembly 32, a conduit system 33 and backup pistons 42.

The probe assembly 32 of the probe module 24 includes a fluid communication device 36 for establishing fluid communication between the downhole tool 10 and the subsurface formation 15 so that fluid can be drawn from the formation 15 into the downhole tool 10 for testing and/or sampling. While the fluid communication device depicted is a probe, dual packers may also be used. Examples of probes and/or packers used in downhole tools are described in U.S. Pat. Nos. 6,301,959; 4,860,581; 4,936,139; 6,585,045; 6,609,568 and 6,719,049 and U.S. Patent Application No. 2004/0000433.

The probe 36 is preferably extendable from the downhole tool 10 for engagement with a well bore wall 38. The probe 36 is operatively connected to the conduit system 33 for drawing fluid therein. Pretest piston 41 is operatively connected to the conduit system for performing pretests. Examples of pretest techniques are depicted in U.S. Pat. No. 6,832,515, assigned to the assignee of the present application.

The conduit system 33 includes internal fluid flow lines that divert fluid from the probe to various positions in the downhole tool. As shown, a first portion 33*a* of the conduit system extends from the probe into the downhole tool. A second portion 33*b* extends from the first portion to the electronics module 30. A third portion 33*c* extends from the first portion to the sampling module 26. A variety of flowline configurations may be used to facilitate fluid communication throughout the downhole tool 10.

While the portions of conduit system 33 is depicted in FIG. 2 as leading from the probe 36 to certain portions of the tool, such as sampling module 26, it will be appreciated by one of skill in the art that the conduit system 33 can include other paths or passages. For example, another passage (not shown) can lead from the probe 36 through the downhole tool 10 to an exit port (not shown) so as to enable transferring of formation fluid directly to the borehole 14, such as during a clean-up operation. The conduit system 33 also preferably includes valves to enable the selective directing of the formation fluid as it flows into and through the downhole tool 10. Additional valves, restrictors, sensors (such as gauges, monitors, etc.) or other flow control or measuring devices may be used as desired.

The sampling module preferably includes at least one sample chamber 44. A variety of sample chambers may be used. Examples of known sample chambers and related techniques are depicted in U.S. Pat. Nos. 4,860,581; 4,936,139; 5,303,775; 5,934,374; 6,745,835 3,254,531; 3,859,851; 5,184,508; 6,467,544; 6,659,177; 6,688,390; 6,769,487; 2003/042021; 2004/0216874; and 2005/0150287.

Figure 3A:
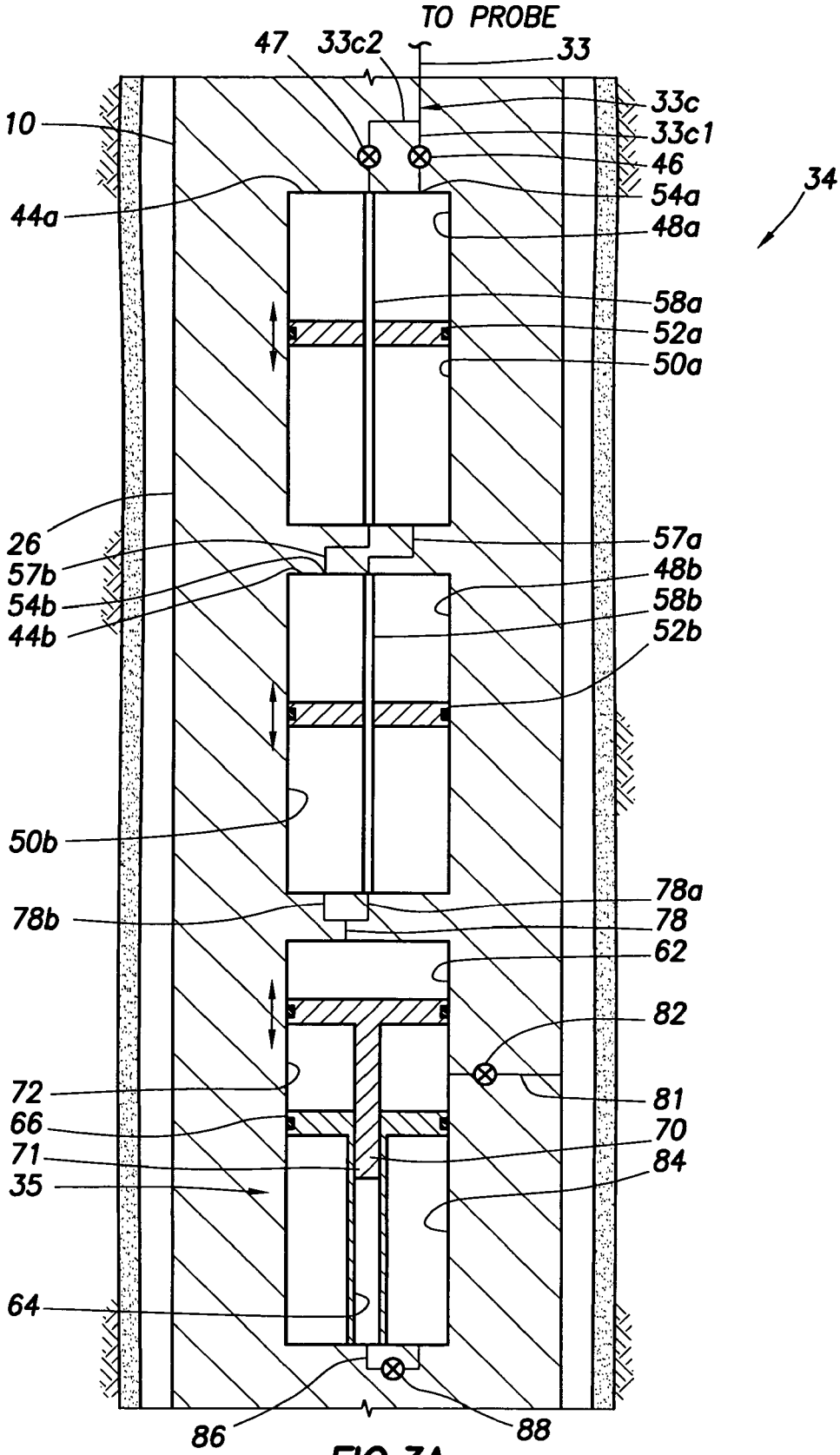
FIG. 3A shows a schematic, partial cross-sectional view of an exemplary formation evaluation system for the downhole tool shown in FIG. 2.
Figure 3B:
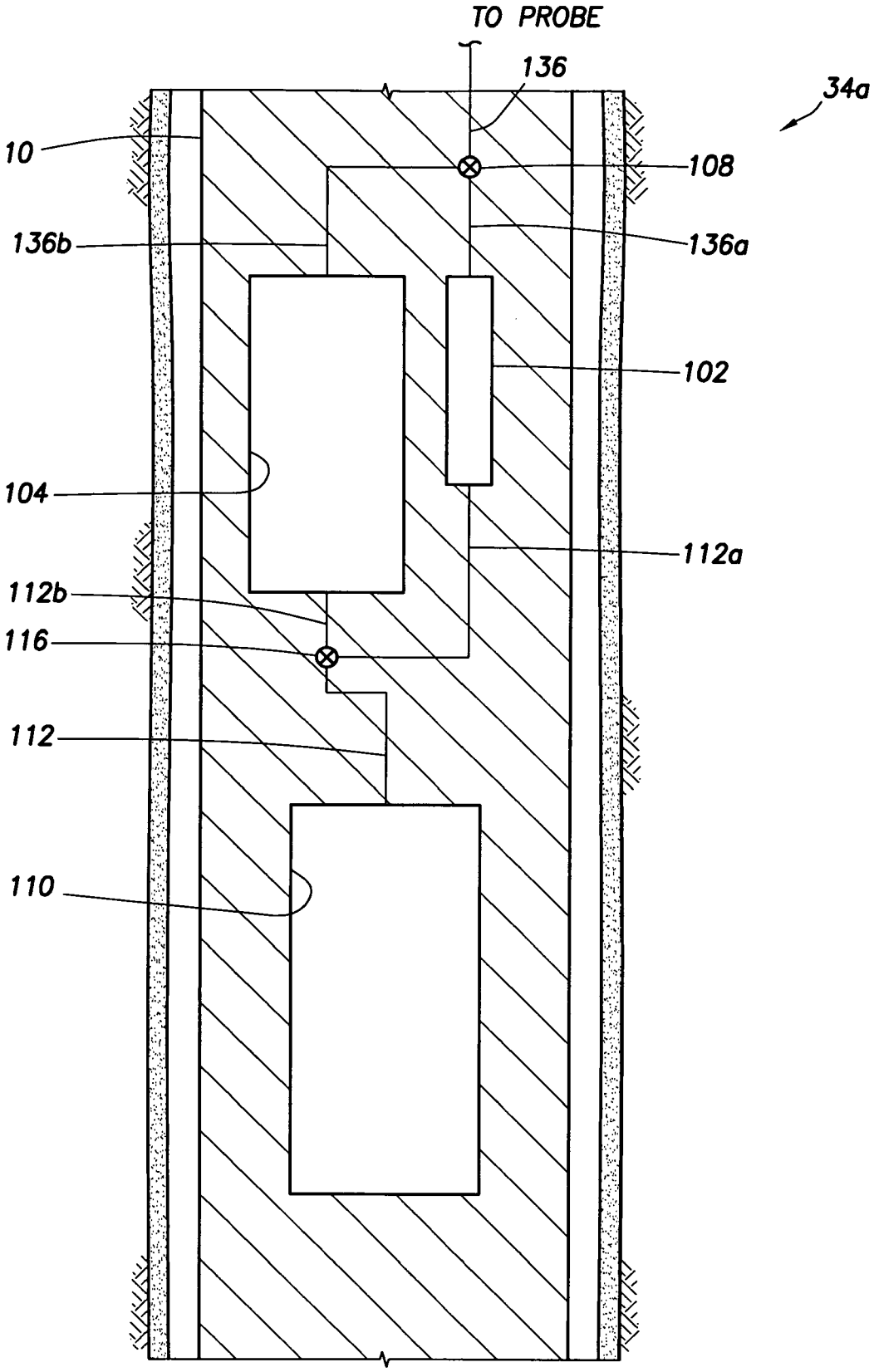
FIG. 3B shows a schematic, partial cross-sectional view of another exemplary formation evaluation system for the downhole tool shown in FIG. 2.

FIGS. 3A and 3B depict sampling systems 34, 34*a* usable in the sample module 26 of the downhole tool of FIGS. 1 and 2. FIG. 3A depicts a sampling system 34 with a pressure compensator 35. FIG. 3B depicts a sampling system 34*a* with a dump chamber. Like other components in the downhole tool described herein, the components of the sampling systems are preferably adapted to operate in harsh conditions.

The sampling system 34 of FIG. 3A includes two sample chambers 44*a* and 44*b* and a pressure compensator 35. The sample chambers are adapted to accept and retain an amount of fluid transferred thereto. As shown in FIG. 3A, the sample chambers include a first variable volume (hereafter referred to as a sample cavity 48*a*, 48*b*), and a second variable volume (hereafter referred to as a buffer cavity 50*a*, 50*b*). The sample cavities 48*a*, 48*b* are adapted to receive and store fluid. The buffer cavities 50*a*, 50*b* are adapted to receive and store a buffer fluid. Examples of fluids that may be used as the buffer fluid include oil, water and air. However, those skilled in the art will appreciate that other types of fluid may be used as the buffer fluid without departing from the spirit of the invention.

The sample cavity 48*a*, 48*b* and the buffer cavity 50*a*, 50*b* of the sample chamber 44*a*, 44*b* are separated and defined by a movable piston 52*a*, 52*b*, or other fluid separator such as a diaphragm or the like, disposed there between. The piston is adapted to slidably move along the interior of the sample chamber resulting in a change in the volume on the sample cavity and the buffer cavity of the sample chamber.

Third portion 33*c* of conduit system 33 leads from the probe 36 through the downhole tool 10 to the sample chambers 44*a* and 44*b*. As shown in FIG. 3A, multiple sample chambers 44*a*, 44*b* and corresponding flowlines 33*c*1, 33*c*2 and valves 46, 47 are provided. Preferably valves 46, 47 are positioned along flowlines 33*c*1, 33*c*2, respectively, of the conduit system to selectively divert formation fluid to the sample chambers 44*a* and 44*b*. While FIG. 3A depicts a preferred arrangement of valves and conduits, it will be appreciated by one of skill in the art that the arrangement may be varied. For example, flowlines and/or valves may be provided for one or more sample chambers. Additionally, such flowlines and/or valves may be positioned along conduit system 33 closer to probe 36. Other variations may also be envisioned.

The sample chambers 44*a* and 44*b* are arranged in fluid communication with third portion 33*c* of the conduit system 33. The sample chambers may be positioned in a variety of locations in the downhole tool. Preferably, the sample chambers are positioned for efficient and high quality receipt of clean formation fluid. Fluid from the third portion 33*c* may be collected in one or more of the sample chambers 44*a* and 44*b*. Further, the sample chambers 44*a* and 44*b* may be interconnected with flowlines that extend to other sample chambers 44, other portions of the downhole tool 10, the borehole and/or other charging chambers.

As shown, sample cavity 48*a* of sample chamber 44*a* is fluidly connected to the conduit system 33. Valve 46 selectively permits fluid to pass from the conduit system into the sample cavity. As fluid enters sample cavity 48*a* through an inlet port 54*a*, buffer fluid in buffer cavity 50*a* applies pressure to the piston. The pressure in the buffer cavity is preferably adapted to permit fluid to gradually enter sample cavity 48*a* in a manner that retains the quality of the sample.

As shown, sample cavity 48*b* of sample chamber 44*b* is fluidly connected to the conduit system 33 via a series of conduits. Valve 47 selectively permits fluid to pass from the flowline 33*c* into sample chamber conduit 58*a*. Sample chamber conduit 58*a* is fluidly connected to sample cavity 44*b* via conduit 57*b*. As fluid enters sample cavity 48*b* through an inlet port 54*b*, buffer fluid in buffer cavity 50*b* applies pressure to the piston. The pressure in the buffer cavity is preferably adapted to permit fluid to gradually enter sample cavity 48*b* in a manner that retains the quality of the sample.

The buffer cavity 50*a* is fluidly connected to pressure compensator 35 via a series of conduits. Conduit 57*a* fluidly connects the buffer cavity 50*a* to a sample chamber conduit 58*b*. A first flowline 78*a* of pressure conduit 78 fluidly connects the sample chamber conduit 58*b* to the pressure compensator 35. A second flowline 78*b* of pressure conduit 78 fluidly connects the sample chamber conduit 58*b* to buffer cavity 50*b*. In this manner, pressure may be balanced between buffer cavity 50*a*, buffer cavity 50*b* and pressure compensator 35.

The buffer cavity 50*b* is fluidly connected to pressure compensator 35 via second flowline 78*b* of pressure conduit 78. Second flowline 78*b* of pressure conduit 78 fluidly connects the buffer cavity 50*b* to sample chamber conduit 58*b*. In this manner pressure may be balanced between buffer cavity 50*b*, buffer cavity 50*a* and pressure compensator 35.

The sampling system is preferably provided with pressure compensator 35 for applying a pressure or force to the sample chamber(s). The pressure compensator may be used to control the flow of fluid into the sample chamber(s) 44. The pressure compensator may also be used to compensate for the pressure or force experienced from the formation pressure while sampling. The pressure compensator may be used in place of, or in combination with, a pump. The pressure compensator may be used to maintain sample integrity and/or to manipulate fluid flow through the flowlines. In some cases, the pressure compensator may be selectively activated to control the fluid flow. In other cases, the pressure compensator may be configured to perform without selective activation.

The pressure compensator 35 has a stationary piston 66 and a movable piston 70 therein defining a first cavity 62, a second cavity 72 and a third cavity 84. The movable piston separates and defines the first cavity 62 and the second cavity 72 positioned within pressure compensation chamber 35 and above stationary piston 66. Third cavity 84 is defined by the portion of the pressure compensation chamber 35 below stationary piston 66.

Movable piston 70 slidably moves within pressure compensation chamber 35 to separate first cavity 62 from second cavity 72 and define the corresponding volumes therein. Stationary piston 66 separates variable volume second cavity 72 from third fixed volume cavity 84. A fourth variable volume cavity 64 is located within stationary piston 66. Rod 71 of movable piston 70 extends into and slidably moves within stationary piston 66 to define fourth variable volume 64.

Fluid in first cavity 62 is fluidly connected via flowline 78 to buffer cavities 50*a*, 50*b*. The fluid in second cavity 72 is in fluid communication with the wellbore via flowline 81. Pressure in third cavity 84 is in fluid communication with fluid in fourth chamber 64 via flowline 86. Valves, such as valves 82 and 88, may be positioned in the flowlines to permit selective fluid communication. In other cases, such valves may be omitted to allow the system to operate without the requirement of actuating valves. In some cases, such valves may be check, throttle or other valves to manipulate flow. Additional flowline devices, such as restrictors, or other fluid manipulators may also be used.

In operation, fluid is admitted into the sample cavities 48*a*, 48*b* through fluid conduit system 33. Fluid may be selectively diverted by activating valves 46 and 47. As fluid flows into the sample cavities, the pistons 52*a*, 52*b* are displaced in response to the change in pressure resulting therefrom. A pressure differential exists between the pressure of the formation fluid in the sample cavities and the pressure provided by the pressure compensator. Typically, the pressure compensator applies a pressure to the buffer cavities to oppose the formation fluid pressure in the sample cavities. Thus, the movable pistons adjust to the opposing pressures in the sample chambers, typically until equilibrium is reached.

The differential pressure provided by the pressure compensator is typically generated by the wellbore or hydrostatic pressure in wellbore cavity 72. In one mode, the flowline 81 may be valveless and wellbore cavity 72 may be open to the wellbore so that it may equalize to the hydrostatic pressure therein. The pressure in wellbore cavity 72 applies a force to piston 70. As a result, cavities 62, 50*a* and 50*b* adjust to the pressure in the wellbore cavity. At the same time, formation pressure in cavities 48*a*, 48*b* applies pressure to buffer cavities 50*a*, 50*b*. Thus, the pressure in the cavities adjusts until equilibrium is achieved therebetween. Desirably, the pressure compensator permits formation fluid to flow gradually into chambers 48*a*, 48*b* to prevent damage thereto. While additional valving, flowlines and pumps may optionally be used, this type of pressure manipulation eliminates the requirement to add such features to draw fluid into the tool and/or manipulate fluid flow and/or pressures.

In another mode, the flowline 81 may be provided with a valve 82 to permit selective fluid communication between wellbore cavity 72 and the wellbore. In this manner, pressure in wellbore cavity 72 may be manipulated to control the force applied to piston 70. As a result, cavities 62, 50*a* and 50*b* may be selectively adjusted to the pressure in the wellbore cavity. At the same time, formation pressure in cavities 48*a*, 48*b* applies pressure to buffer cavities 50*a*, 50*b*. Thus, the pressure in the cavities may be selectively adjusted until equilibrium is achieved therebetween. Preferably, the pressure compensator is manipulated to permit formation fluid to flow as desired into chambers 48*a*, 48*b*. A valve 88 may also be provided in flowline 86 to selectively bleed off any excess pressure in the pressure compensator to chamber 84. In this manner, the flow of fluid into the chambers and the pressures contained in certain cavities may be manipulated. Pressure balancing may be selectively achieved for one or more of the cavities.

The pressure compensator 35 is preferably a device fluidly connected to one or more sample chambers for applying a pressure or force to compensate for the pressure or force experienced from the formation pressure. While FIG. 3A depicts one pressure compensator 35, it will be appreciated by one of skill in the art that a variety of one or more pressure compensators may be used with one or more sample chambers in a variety of locations throughout the downhole tool.

The pressure compensator may be a piston or other device capable of balancing the pressures in the chamber. The pressure compensator may be used to create a pressure differential in the chambers to induce formation fluid to flow into the sample cavities. In some high temperature applications, pumps may fail. Thus, it is sometimes desirable to provide a pressure compensator to create the pressure differential to drive fluid into the tool. The pressure compensator can be a passive device that does not require a power supply. Rather, the pressure compensator can obtain its energy from the pressure differential between at least two different pressure sources, such as from the formation and an internal pressure chamber. However, in some cases, it may be desirable to provide an active pressure compensator device.

While FIG. 3A depicts two sample chambers 44*a* and 44*b* for collecting samples for simplicity, it will be appreciated by one of skill in the art that a variety of one or more identical or different sample chambers may be used. Further, while the sample chambers 44*a* and 44*b* are depicted in FIG. 3A as being identical and positioned serially, one or more sample chambers 44 can be positioned in series and/or parallel.

Referring now to FIG. 3B, an alternate fluid sampling system 34*a* of downhole tool 10 is depicted. The sample system 34*a* includes a sample chamber 102 and a dump chamber 104. Preferably, the sample chamber 102 is interconnected in parallel with the dump chamber 104. A pressure chamber 110 is also preferably provided to apply a pressure to the sample and/or dump chambers. However, alternate configurations of one or more various sized sample, dump and/or pressure chambers positioned in series and/or parallel in various portions of the downhole tool may be used.

The sampling system 34*a* may be used in the downhole tool in addition to, or in place of the sampling system 34 of FIG. 3A. The sampling system may be positioned in one or more modules in various locations about the downhole tool. Flowline 136 may be operatively connected to the probe and/or existing flowlines, such as one or more of the flowlines of conduit system 33 (FIG. 2).

The sample chamber 102 and the dump chamber 104 can be constructed in a variety of manners. For example, the sample chamber 102 can be constructed in a similar manner as the sample chambers 44A and 44B shown in FIG. 3A. Also, one or more of the sample chambers can function as one or more dump chambers 104. Further examples of sample chambers, dump chambers and/or related configurations may be seen in U.S. Pat. Nos. 3,859,851; 6,467,544; 6,659,177; 6,688,390; 6,769,487; 2003/042021; and 2005/0150287.

A flowline 136 fluidly connects the probe through the downhole tool to the sample chamber 102 and the dump chamber 104. A first flowline 136*a* fluidly connects flowline 136 to the sample chamber 102. A second flowline 136*b* fluidly connects flowline 136 to the dump chamber 104. Valve 108 selectively diverts fluid from flowline 136 to first and second flowlines 136*a*, 136*b*. Typically, the dump chamber 104 is filled before the sample chamber 102 to remove contamination. After a certain amount of fluid enters the dump chamber, or when the fluid is determined to be clean, fluid may be diverted into the sample chamber 102.

Sample chamber 102 and dump chamber 104 are operatively connected to pressure chamber 110 via flowline 112. A first flowline 112*a* extends from flowline 112 to sample chamber 102. A second flowline 112*b* extends from flowline 112 to dump chamber 104. Valve 116 is provided to permit selective fluid communication with the pressure chamber 110 to apply pressure thereto.

The pressure chamber 110 may be a chamber with gas, such as an atmospheric chamber. The pressure chamber 110 may also be constructed in a similar manner as the pressure compensator 35 shown in FIG. 3A. The chambers of FIGS. 3A and 3B may be used interchangeably as desired to achieve the desired sample and/or pressures.

Figure 4:
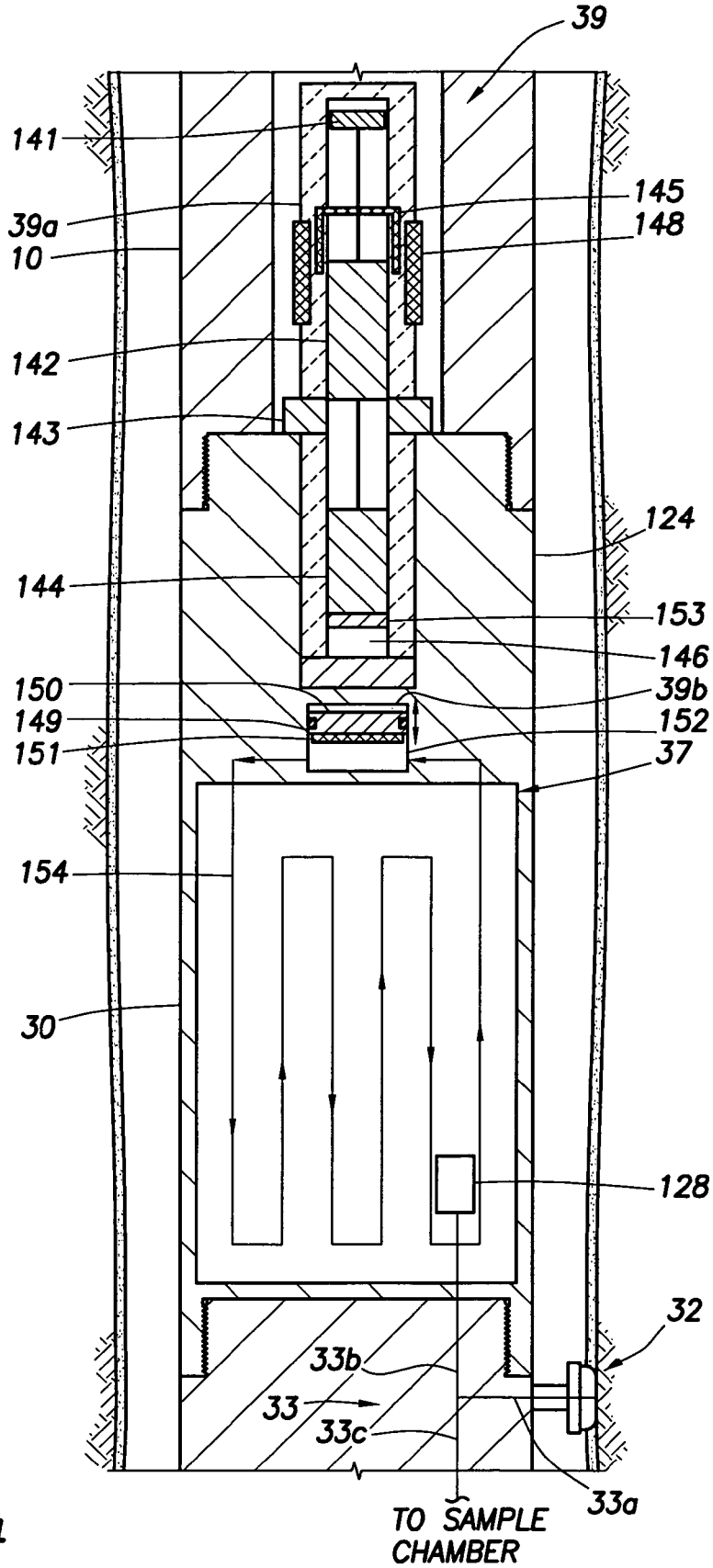
FIG. 4 shows a schematic, partial cross-sectional view of an exemplary cooling system for the downhole tool shown in FIG. 2.

Referring now to FIG. 4, the electronics module 30 of FIGS. 1 and 2 is shown in greater detail. The electronics module 30 includes electronics 37 and a cooling system 39. Cooling system 39 includes a cooling driver 39*a* and a cooling flow unit 39*b*. The cooling drive 39*a* preferably includes a Stirling cooler, such as the one described in co-pending U.S. Patent Application No. 2005/0097911, assigned to the assignee of the present application.

As shown, the cooling driver 39*a* is a Stirling cooler that operates in cooperation with the cooling flow unit 39*b*. The Stirling cooler is preferably positioned adjacent the cooling flow unit 39*b* for magnetic cooperation therebetween.

The cooling flow unit 39*b* is operatively connected to the electronics 37 for passing a cooling fluid therethrough. Most or all of the electronics of the downhole tool are preferably consolidated into a location adjacent to the cooling flow unit 39*b* and/or components thereof for more efficient operation. However, one or more cooling systems may be positioned at various locations about the tool to provide cooling where needed. Cooling flowlines may also be positioned throughout the tool to pass cooling fluid near heat bearing objects to remove and/or dissipate heat therefrom.

The Stirling cooler 39*a* includes two pistons 142, 144 disposed in cylinder 146. The cylinder 146 is filled with a working gas, typically air, helium or hydrogen at a pressure of several times (e.g., 20 times) the atmospheric pressure. The piston 142 is coupled to a permanent magnet 145 that is in proximity to an electromagnet 148 fixed on the housing. When the electromagnet 148 is energized, its magnetic field interacts with that of the permanent magnet 145 to cause linear reciprocating motion of piston 142. Thus, the permanent magnet 145 and the electromagnet 148 form a moving magnet linear motor.

The particular sizes and shapes of the magnets shown are for illustration only and are not intended to limit the scope of the invention. One skilled in the art will also appreciate that the locations of the electromagnet and the permanent magnet may be reversed, i.e., the electromagnet may be fixed to the piston and the permanent magnet fixed on the housing (not shown).

The electromagnet 148 and the permanent magnet 145 may be made of any suitable materials. The windings and lamination of the electromagnet are preferably selected to sustain high temperatures (e.g., up to 260.degree. C.). In some embodiments, the permanent magnets of the linear motors are made of a samarium-cobalt (Sm—Co) alloy to provide good performance at high temperatures. The electricity required for the operation of the electromagnet may be supplied from the surface, from conventional batteries in the downhole tool, from generators downhole, or from any other means known in the art.

The movement of piston 142 causes the gas volume of cylinder 146 to vary. Piston 144 can move in cylinder 146 like a displacer in the kinematic type Stirling engines. The movement of piston 144 is triggered by a pressure differential across both sides of piston 144. The pressure differential results from the movement of piston 142. The movement of piston 144 in cylinder 146 moves the working gas from the downhole of piston 144 to the uphole of piston 144, and vice-versa. This movement of gas coupled with the compression and decompression processes results in the transfer of heat from object 147 to heat dissipating device 143. As a result, the temperature of the object 147 decreases. The Stirling cooler 39 may include a spring mass 141 to help reduce vibrations of the cooler resulting from the movements of the pistons and the magnet motor.

The Stirling cooler 39 in FIG. 4 may be used to cool object 147. The Stirling cooler is also adapted to drive the cooling flow unit 39*b*. In particular, the reciprocating action of the Stirling cooler may be magnetically coupled to and drive a cooling pump 149 to cool the electronics 37. A magnet 153 is coupled to piston 144 to magnetically drive the cooling pump 149. The cooling pump 149 includes an electronics piston 150 having a permanent magnet 151 attached thereto. The piston 150 and attached magnet 151 are positioned in a pump chamber 152 and magnetically driven by reciprocating magnet 153. The pump chamber 152 is preferably positioned adjacent the Stirling cooler for operative cooperation therewith.

The electronics magnet 150 is slidably positioned in the pump chamber 152 and reciprocates therein in response to the magnetic field created by the Stirling cooler. The reciprocating electronics magnet pumps cooling fluid through a cooling flowline 154 positioned near the electronics. The cooling flowline 154 preferably forms a closed loop that passes through the electronics 37, or a chassis supporting the electronics, to dissipate heat therefrom. One or more cooling flowlines in a variety of configurations may be positioned throughout various portions of the tool to cool such portions as desired.

The electronics are preferably mounted on a chassis, electronics housing or other mounting means to support the electronics in the Dewar flask. The electronics chassis is preferably made of a material of high thermal mass or high thermal conductivity, such as copper, to serve as a heat sink. This heat sink may be used in combination with the cooling system to dissipate heat. Additionally, should the cooling system fail, or not be in use, the heat sink may be used to absorb and/or spread the heat.

While FIG. 4 shows a Stirling cooler 39*a* having a magnet motor that uses electricity to power the Stirling cooler, one skilled in the art will appreciate that other energy sources (or energizing mechanisms) may also be used. For example, operation of the Stirling cooler (e.g., the back and forth movements of piston 142 in FIG. 4) may be implemented by mechanical means, such as a fluid-powered system that uses the energy in the mud flow coupled to a valve system and/or a spring (not shown).

In cases where drilling tools are used, the hydraulic pressure of mud flowing through the drilling tool could be used to push the electronics magnet, or piston, in one direction, while a spring is used to move the piston in the other direction. A conventional valve system is used to control the flow of mud to the Stirling piston in an intermittent fashion. Thus the coordinated action of a hydraulic system, a spring, and a valve system results in a back and forth movement of the piston 142. A corresponding pumping mechanism may then be used in place of the cooling pump 149. The pumps can be powered by a cooler power network or using independent power means.

The electronics module can be any device capable of housing or supporting electronics disposed therein. While some electronics may be dispersed throughout the tool, the electronics are preferably consolidated into a single portion of the tool, or a single module. These electronics may include, for example, sources, sensors or other heat sensitive parts that need to function in a harsh downhole environment. Preferably, the electronics are mounted on the electronics chassis and supported within the electronics module.

Preferably, the electronics module 30 is provided with an insulated housing 124, such as a Dewar flask, adapted to thermally isolate the electronics contained therein. The housing 124 is preferably adapted to support, protect and insulate the electronics 37 and, if desired, at least a portion of the Stirling cooler 39. Also, the housing 124 can be provided with additional thermal layer or barriers to further insulate the electronics contained therein. Preferably, the insulated housing is sufficient to provide a heat barrier between the electronics module and the probe, and/or sampling modules.

Preferably, the electronics disposed in the electronics module 30 includes one or more gauges 128, such as a quartz gauge, strain gauge or other sensor(s). A flowline 33*b* of the conduit system 33 extends from the probe 32 to the electronics module 30. Preferably, the fluid in the flowline is fluidly connected to gauge 128 so that characteristics of the fluid in the flowline may be measured. A buffer fluid is preferably positioned in the flowline 33*b* to act as a buffer fluid between the formation fluid and the gauge. Such a buffer fluid may be used to prevent contamination of the flowline and/or gauge (s).

Gauge 128 depicts an example of a gauge or sensor positionable with the electronics. The gauge 128 is supported by the electronics chassis and positioned adjacent cooling flowline 154 so that heat may be carried away by the coolant passing through the cooling flowline.

Gauge 128 is preferably a pressure sensor, such as a pressure gauge or the like, which is capable of measuring or monitoring the formation pressure based on the pressure of the formation fluid entering the probe 32. However, the gauge 128 can be any type of device adapted to sense or measure other properties and characteristics of the formation fluid entering the probe, such as density, resistivity and/or contamination levels. One or more of various types of gauges may be placed in the electronics module as desired. Also, one or more sensors may be disposed at various locations throughout the downhole tool (ie. along the flowlines and/or chambers to enable monitoring of the downhole fluids). These sensors may be sensors, gauges, monitors or other devices capable of measuring properties of the fluids and/or downhole conditions, such as density, resistivity or pressure. The data collected in the tool may be transmitted to the surface and/or used for downhole decision making.

Appropriate computer devices, processing equipment and/or other electronics may be provided to achieve these capabilities or other functions. For example, a processor (not shown) may be used to collect, analyze, assemble, communicate, respond to and/or otherwise process downhole data. The downhole tool may be adapted to perform commands in response to the processor equipment, such as activating valves. These commands may be used to perform downhole operations.

The downhole tool can be provided with other means for assisting the formation evaluation process. For example, a clean-up operation may be carried out prior to capturing a sample in at least one sample chamber wherein a portion of the formation fluid is directed to a borehole exit (not shown) before the formation fluid is allowed to enter the at least one sample chamber. Formation fluid may be directed to the borehole exit port (not shown) until it is determined that the formation fluid flowing from the formation is substantially free of contaminants and debris. Furthermore, the downhole tool can be provided with additional filters or other components to selectively remove a contaminated portion of the formation fluid from the sample chamber, such as described in U.S. Patent Application No. 2005/0082059.

It will be understood from the foregoing description that various modifications and changes may be made in the preferred and alternative embodiments of the present invention without departing from its true spirit. For example, embodiments of the invention may be easily adapted and used to perform specific formation sampling or testing operations without departing from the scope of the invention as described herein.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A formation evaluation tool positionable in a wellbore penetrating a subterranean formation, comprising:

a cooling system adapted to pass a cooling fluid through electronics disposed in at least one container in the formation evaluation tool whereby heat is dissipated therefrom, the electronics comprising at least one gauge;

a fluid communication device having an inlet adapted to receive the formation fluid;

a flowline operative connected to the fluid communication device and the at least one gauge for placing the formation fluid in fluid communication therewith whereby properties of the formation fluid are determined;

at least one sample chamber operatively connected to the flowline; and a pressure compensator operatively connected to the at least one sample chamber and in fluid communication with the wellbore for balancing a pressure therein with a pressure in the sample chamber;

wherein the pressure compensator comprises a chamber having a movable piston and a stationary piston therein, the movable piston slidably movable therein and defining a first variable cavity and a second variable cavity, the stationary piston separating the second variable cavity from a third variable cavity.

2. A formation evaluation tool positionable in a wellbore penetrating a subterranean formation, comprising:

a fluid communication device having an inlet adapted to receive the formation fluid;

a flowline operative connected to the fluid communication device;

a plurality of sample chambers operatively connected to the flowline for collecting at least a portion of the formation fluid; and at least one sample chamber operatively connected to the flowline; and a pressure compensator in fluid communication with the wellbore and operatively connected to the plurality of sample chamber for applying pressure to the sample chambers whereby pressure is balanced therebetween, the pressure compensator including a movable piston slidably positionable therein, the movable piston defining a first cavity in fluid communication with buffer cavities of the plurality of sample chambers, wherein each sample chamber has a piston slidably movable therein, the pistons defining a sample cavity for receiving formation fluid and the buffer cavity include communication with the pressure compensator.

3. The formation evaluation tool of claim 2 wherein the buffer cavities of each sample chamber are in fluid communication with each other.

4. The formation evaluation tool of claim 2 wherein the movable piston further defines a second cavity in selective fluid communication with the wellbore.

5. The formation evaluation tool of claim 4 wherein the pressure compensator has a stationary piston therein separating the second cavity from a third cavity, a rod of the movable piston slidably positionable in the stationary piston, the stationary piston and the rod of the movable piston defining a fourth cavity.

6. The formation evaluation tool of claim 5 wherein the fourth cavity is in selective fluid communication with the third cavity for selectively releasing pressure therein.

7. The formation evaluation tool of claim 5 wherein the fourth cavity is in fluid communication with the third cavity for releasing pressure therefrom.

8. A method of performing formation evaluation via a downhole tool positioned in a wellbore penetrating a subterranean formation, comprising:

removing heat from electronics disposed in at least one container in the downhole tool by passing a cooling fluid through the electronics, the electronics comprising at least one gauge;

establishing fluid communication between a fluid communication device and the formation, the fluid communication device having an inlet adapted to receive a formation fluid from the formation;

establishing fluid communication between the inlet and the at least one gauge via a flowline;

measuring at least one parameter of the formation fluid via the gauge;

passing at least a portion of the formation fluid into a plurality of sample chambers, each of the plurality of sample chambers having a movable piston slidably positioned therein, the movable piston defining a sample cavity and a buffer cavity; and establishing fluid communication between the wellbore and a wellbore cavity of a pressure compensator and balancing the pressure between the buffer cavities and the wellbore cavity.

9. A method of performing formation evaluation via a downhole tool positioned in a wellbore penetrating a subterranean formation, comprising:

removing heat from electronics disposed in at least one container in the downhole tool by passing a cooling fluid through near the electronics, the electronics comprising at least one gauge;

establishing fluid communication between a fluid communication device and the formation, the fluid communication device having an inlet adapted to receive a formation fluid from the formation;

establishing fluid communication between the inlet and the at least one gauge via a flowline;

measuring at least one parameter of the formation fluid via the gauge;

passing at least a portion of the formation fluid into a plurality of sample chambers, each of the plurality of sample chambers having a movable piston slidably positioned therein, the movable piston defining a sample cavity and a buffer cavity; and establishing selective fluid communication between the wellbore and a wellbore cavity of a pressure compensator and balancing the pressure between the buffer cavities and the wellbore cavity.

10. A method of performing formation evaluation via a downhole tool positioned in a wellbore penetrating a subterranean formation, comprising:

establishing fluid communication between a fluid communication device and the formation, the fluid communication device having an inlet adapted to receive a formation fluid from the formation;

drawing formation fluid through the inlet and into a plurality of sample chambers via a flowline, each of the plurality of sample chambers having a movable piston slidably positioned therein, the movable piston defining a variable volume sample cavity and a variable volume buffer cavity, the variable volume sample cavity adapted to receive the formation fluid;

establishing fluid communication between a first cavity of a pressure compensator and the wellbore;

establishing fluid communication between a second cavity of the compensator and at least one of the variable volume buffer cavities; and balancing the pressure between the variable volume buffer cavities and the first cavity.

11. The method of claim 10 further comprising measuring at least one parameter of the formation fluid via at least one gauge.

12. The method of claim 11 further comprising positioning a buffer fluid in a flowline extending from the inlet to the at least one gauge.

13. The method of claim 11 further comprising cooling the gauge by passing a cooling fluid near the gauge.

14. A formation evaluation tool positionable in a wellbore penetrating a subterranean formation, comprising:

a fluid communication device having an inlet adapted to receive a formation fluid;

a flowline operatively connected to the fluid communication device;

a plurality of sample chambers operatively connected to the flowline for collecting at least a portion of the formation fluid; and a pressure compensator in fluid communication with the wellbore and operatively connected to the plurality of sample chambers for applying pressure to the sample chambers whereby pressure is balanced therebetween, the pressure compensator including a movable piston slidably positionable therein, the movable piston defining a first cavity in fluid communication with buffer cavities of the sample chambers and a second cavity in fluid communication with the wellbore.

* * * * *